US005548904A

United States Patent [19]

Rood

[11] Patent Number: 5,548,904

[45] Date of Patent: Aug. 27, 1996

[54] ARTICLE CATCHER FOR CLOTHES DRYER

[75] Inventor: John D. Rood, Fountain Hills, Ariz.

[73] Assignee: Innoventions, Fountain Hills, Ariz.

[21] Appl. No.: 432,598

[22] Filed: May 1, 1995

[51] Int. Cl.[6] ..... F26B 21/06

[52] U.S. Cl. ..... 34/82; 34/597

[58] Field of Search ..... 34/597, 600, 82

[56] References Cited

U.S. PATENT DOCUMENTS

| | | | |
|---|---|---|---|
| 2,546,925 | 3/1951 | Geldhof et al. | 34/82 |
| 2,776,826 | 1/1957 | Bennett et al. | 34/82 |
| 3,047,963 | 8/1962 | Richterkessing | 34/82 |
| 3,320,678 | 5/1967 | Berke | 34/82 |
| 3,378,934 | 4/1968 | Erickson | 34/82 |
| 4,557,058 | 12/1985 | Ozawa | 34/82 |

FOREIGN PATENT DOCUMENTS

| | | | |
|---|---|---|---|
| 63857 | 12/1952 | France | 34/82 |
| 2702270 | 10/1978 | Germany | 34/82 |

*Primary Examiner*—John T. Kwon
*Attorney, Agent, or Firm*—Gregory J. Nelson

[57] ABSTRACT

A catcher for catching items such as pens, coins, lipsticks and crayons which may have inadvertently been left in clothing placed in a clothes dryer. The catcher comprises an elongate tray mountable to the interior surface of the door or other stationary surfaces within the dryer. The tray may be integrally formed as part of the dryer such as on the interior surface of the door or may be detachably secured by brackets, adhesives or magnetic securement devices. The tray may include a removable liner. In an alternate embodiment of the invention, the tray has a funnel-like configuration which communicates with a discharge conduit to transfer items to a receptacle exterior of the drying chamber.

10 Claims, 1 Drawing Sheet

16
20
14
30
10
12

39
30
6

50
51
30
16

40
32
39
34
48

36
30
32
36
42

30
28
38
35
41

16
30
75
82
60
62
84
66
80
86

72
75
78
66
74
70
68

ARTICLE CATCHER FOR CLOTHES DRYER

FIELD OF THE INVENTION

The present invention relates to an article catcher and more particularly relates to a tray for installation in a clothes dryer to retrieve small objects and articles such as coins, pencils, pens and lipsticks which are inadvertently left in clothing deposited in the dryer.

BACKGROUND OF THE INVENTION

Clothes dryers, both electric and gas, are commonly found in residential use. Dryers of this type generally have a front opening door, opening into a compartment in which a large, cylindrical drum is mounted for rotation about a horizontal axis. Clothing to be placed in the dryer is imparted a tumbling action by the rotation of the drum which promotes drying of the clothing. One problem is that small objects such as coins, pens, lipsticks and the like are often inadvertently left in a pocket of the clothing placed in the dryer. The temperature in a typical dryer reaches somewhere between 140° F. to 160° F. temperature. Coins and similar small metal objects due to the tumbling action may simply cause an annoying rattle and possible damage to the drum and finish as these type of objects strike the metal drum. Other items such as pens and lipsticks, due to the high temperatures within the dryer, may melt or leak causing ink or petroleum-based materials to run or melt, soiling the clothing that are drying. Such stains, due to the temperature within the dryer, can become heat-set making subsequent removal of such stains difficult. Further, the soiling or staining may spread to most of the other articles of clothing placed within the dryer.

In view of the foregoing, there exists a need for a simple device for catching and retrieving loose items that may be inadvertently deposited in a clothes dryer along with clothing to be dried.

SUMMARY OF THE INVENTION

The present invention provides a receptacle or container for catching loose objects within a clothes dryer. The device consists of an elongate tray which is securable within the dryer compartment such as on the interior surface of the door or possibly on other stationary surfaces within the dryer. Preferably the tray extends horizontally across the surface a substantial part of the dimension, such as the width of the dryer door. The tray is made from a suitable heat-resistant material and is also preferably located in a lower portion of the dryer. Objects such as coins, pens, lipsticks and the like will tend to migrate toward the interior door and will be caught in the tray.

The tray may be provided as an integral part of the dryer or may be detachably secured to the dryer by various attachment means such as magnets, adhesive or brackets which allow for removal of the tray for cleaning.

In alternate embodiments, the tray may be provided with a separate removable liner and the tray may be in communication with a discharge leading to the exterior of the dryer across a suitable sealed enclosure such as a rubber, resilient flapper.

BRIEF DESCRIPTION OF THE DRAWINGS

The above and other objects of the present invention will be more fully understood from the following description, claims and drawings in which:

DETAILED DESCRIPTION OF THE INVENTION

Figures 1, 2, 3, 4, 5, 6, 7, 8:
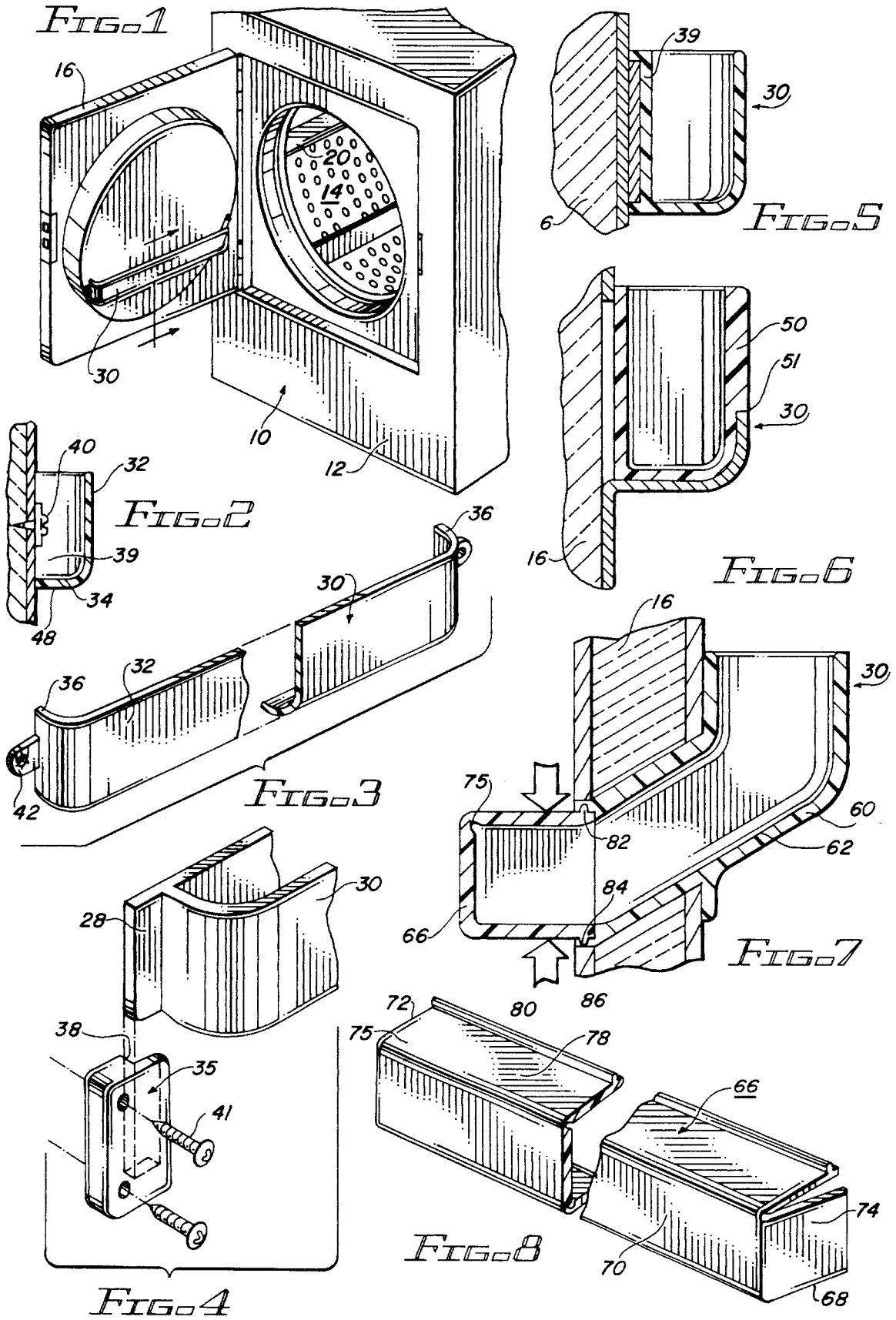
FIG. 1 is a perspective view of a clothes dryer with the door open showing the tray located thereon.
FIG. 2 is a sectional view taken along line 2—2 of FIG. 1.
FIG. 3 is a perspective view of the tray shown in FIG. 1.
FIG. 4 is a detail view showing an alternate tray mounting arrangement.
FIG. 5 is a sectional view showing yet another tray mounting arrangement.
FIG. 6 is a sectional view of a tray integrally formed as part of the dryer door and further including a removable liner.
FIG. 7 is a sectional view of the dryer door incorporating another embodiment of the invention having a conduit for captured items, which conduit leads to an exterior receptacle.
FIG. 8 is a perspective view of the receptacle.

Turning now to the drawings, FIGS. 1 to 3 illustrate a preferred embodiment of the present invention shown in conjunction with a conventional clothes dryer. The dryer 10 is of typical construction and has a cabinet 12 which has a drying chamber or enclosure 14 which is accessed by means of front opening door 16. Within the drying chamber is a drum 20 which is rotated about a horizontal axis by means of a transmission, not shown. The dryer is also provided with a heater, which may be either gas or electric, as is conventional. The construction of the dryer per se forms no particular part of the present invention.

In operation, clothes to be dried are placed within the tumbler and the dryer operated by means of controls located on the dryer. The operator selects the appropriate temperature for the type of clothing and fabric placed in the dryer and sets a drying cycle. The door is closed and clothing is tumbled within the dryer and the heater will elevate the temperature within the drying chamber to between 140° F. to 160° F.

Personal items such as pencils, crayons, lipsticks, coins and rubber bands are often inadvertently left in clothing placed in the dryer. As is known, metallic items will rattle within the dryer creating an annoyance and may cause damage to the drum. Items such as crayons, lipsticks and other cosmetics as well as pens, can cause stains to clothing within the dryer. The inks in pens, such as ball point pens, will run and the wax and petroleum bases of crayons and lipsticks will also melt resulting in serious staining.

It has been found that most loose items within the dryer will generally migrate towards a stationary vertical surface of the dryer such as toward the interior surface of the door 16.

In accordance with the present invention, an elongate tray 30 is secured to the interior surface of door 16 at a location along the lower edge of the door. The elongate tray or receptacle 30 has a front wall 32, a bottom wall 34 and opposite end walls 36 and 38. Preferably, the overall length of the tray is approximately 8 to 12 inches and the overall depth an inch or so, with the height approximately 1 to 2 inches. The end walls and bottom walls may be smoothly contoured as best shown in FIG. 3. An upstanding rear wall 39 is generally planar and abuts the inner surface of the door 16.

Mounting means are provided to secure the tray to the door and may consist of sheet metal screws 40 extending through oppositely extending tabs 42 at the end walls.

In FIG. 4, the tray 30 has oppositely extending flanges 28 at the ends of the tray. Mounting bracket 35 is secured to the door interior by metal screws 41. A recess 38 in the edge of each of the brackets removably receives the flanges 28 allowing the tray to be inserted or removed as required.

Alternatively, as seen in FIG. 5, rear wall 39 of the tray may include one or more magnets 45 which are embedded into the rear wall during the molding process. Since most clothes dryers are metal coated with an enamel, the magnets will adhere to the stationary door surface. Magnetic fixation of the tray is advantageous in that it allows the tray to be removed for cleaning.

It has been observed that most loose objects will migrate into the receptacle of the tray within the first few minutes of the cycle of dryer operation. Thus, the user can turn on the dryer and after a few minutes of operation, open the door and remove any objects so that the objects do not remain in the dryer enclosure during the remainder of the drying cycle minimizing the potential for soiling during the drying cycle.

In FIG. 6 an alternate embodiment of the present invention is shown in which the tray 30 is generally configured as described above but is provided and integrally formed as part of the interior of door 16. The shape of the tray can be pressed or stamped from the material of the door as it is being manufactured. Since the tray is not removable for cleaning in this embodiment, it is preferred that a removable liner 50 having the general shape of the interior of the tray be provided to the user. The liner should be suitable heat-resistant material which would have an upper lip which engages the upper edge of the tray and secure the liner in place. When the user wishes to remove articles contained within the tray or the user wishes to clean the tray, the liner 50 may simply be disengaged and removed from the tray and replaced as necessary.

As indicated above, the user may inspect the receptacle after the first few minutes if dryer operation to see if any items have collected in the receptacle or tray and remove them so they do not remain within the dryer enclosure during the remainder of the drying cycle.

In another embodiment of the present invention as shown in FIGS. 7 and 8, the tray 30, which is shown as an integrally formed component, is provided as an original equipment component, is shown. The tray is as has been described with reference to FIG. 6 and further includes bottom surface 60 which is somewhat funnel shaped to direct items that collect within the tray to the discharge chute 62. The discharge chute 62 communicates with a discharge receptacle 66 which is located exteriorly of the drying chamber such as at a location on the front of the dryer beneath the door. The chute 62 will allow items to pass to the exterior collection receptacle and the receptacle is closed to prevent excessive loss of heat through the chute. Also, since the items pass to the exterior of the dryer they are removed from the heating chamber and therefore are less likely to melt in the case of crayons, lipsticks and the like.

The receptacle 62 is elongate having a bottom wall 68, front wall 70 and end walls 72, 74. Top wall 78 is connected to front wall 70 at living hinge 75. This permits the receptacle to be engaged or disengaged from the conduit by inserting or removing lips 80, 84 from grooves 82, 86 at the end of the chute 62 at the exterior of the door 16. This allows the user to remove objects without opening the dryer to interrupt the drying cycle. The receptacle may be transparent plastic for convenience to allow the user to quickly inspect for retrieved objects.

The tray could also be formed as a part of the filter assembly which is a component of conventional dryers. The filter normally includes a removable screen below the door and the tray can be attached to the filter.

From the foregoing, it will be seen that the present invention provides a very simple yet highly effective and desirable accessory feature for a conventional clothes dryer. The device is easy to manufacture and be provided as an aftermarket accessory which may be attached by the user. Alternatively, the tray/ receptacle may be manufactured as an OEM component.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. In a clothes dryer of the type having a cabinet with a rotatable drum therein in which heated air passes through the clothes tumbled by the drum, the cabinet having a door with an interior surface and opening into the open end of the drum, the improvement comprising an article catcher for collecting loose articles in the dryer, said article catcher comprising:

(a) a tray having a wall defining a generally elongate collection area;

(b) attachment means securing said tray against the interior surface of said door with said collection area being generally upwardly disposed and in a horizontal position extending substantially across the said door opening whereby said loose articles migrating toward said door during tumbling will be caught and retained in said tray.

2. The article catcher of claim 1 wherein said tray is plastic.

3. The article catcher of claim 1 wherein said attachment means comprise adhesive means.

4. The article catcher of claim 1 wherein said attachment means comprise magnetic means.

5. The article catcher of claim 1 wherein said attachment means comprise bracket means detachably engaging said tray.

6. The article catcher of claim 1 further including a removable liner nestable in said collection area.

7. The article catcher of claim 1 wherein said wall includes a front wall and a bottom wall and opposite end walls and wherein said bottom wall communicates with a discharge conduit terminating at a location exteriorly of said heating chamber.

8. The article catcher of claim 7 wherein said discharge conduit terminates at a removable receptacle.

9. The article catcher of claim 1 wherein said attachment means forms an integral component of said door.

10. The article catcher of claim 1 wherein said attachment means detachably secures said tray to said interior door surface.

* * * * *